US005885311A

United States Patent [19]

McCutcheon et al.

[11] Patent Number: 5,885,311

[45] Date of Patent: Mar. 23, 1999

[54] ABRASIVE PRODUCTS

[75] Inventors: William F. McCutcheon, Clifton Park, N.Y.; Constantinos Caracostas, Shrewsbury, Mass.; Ralph Bauer, Niagra Falls, Canada; Gregg M. Bosak, Hoosick Falls; Gary J. Kardys, North Greenbush, both of N.Y.

[73] Assignee: Norton Company, Worcester, Mass.

[21] Appl. No.: 869,351

[22] Filed: Jun. 5, 1997

[51] Int. Cl.[6] ..... B24D 3/34

[52] U.S. Cl. ..... 51/295; 51/309; 51/307

[58] Field of Search ..... 51/293, 295, 307, 51/309

[56] References Cited

U.S. PATENT DOCUMENTS

| | | | |
|---|---|---|---|
| 1,830,757 | 11/1931 | Hartmann | 51/308 |
| 3,476,537 | 11/1969 | Markotan | 51/296 |
| 4,543,106 | 9/1985 | Parekh | 51/295 |
| 5,011,512 | 4/1991 | Wald et al. | 51/295 |
| 5,103,598 | 4/1992 | Kelly | 51/295 |
| 5,695,533 | 12/1997 | Kardys et al. | 51/295 |
| 5,725,162 | 3/1998 | Garg et al. | 241/1 |

FOREIGN PATENT DOCUMENTS

| | | | |
|---|---|---|---|
| 494435 | 12/1991 | European Pat. Off. | B24D 3/34 |

*Primary Examiner*—Deborah Jones
*Attorney, Agent, or Firm*—David Bennett

[57] ABSTRACT

Coated abrasive materials can be made from a substrate and, adhered to the substrate by a maker coat, weak shaped abrasive grits with, interspersed between the abrasive grits, a plurality of non-abrasive particles that are smaller than the abrasive grits which serve to raise the level of a size coat applied over the maker coat and abrasive grits such that the abrasive grits are anchored over a greater part of their length without the need for the application of a large volume of size coat and such that a grinding adjuvant included in the topmost coat is located adjacent the tips of the abrasive grits which perform the grinding when the coated abrasive is in use.

10 Claims, 1 Drawing Sheet

ABRASIVE PRODUCTS

BACKGROUND OF THE INVENTION

This invention relates to abrasive products and specifically to coated abrasives and a process for making such products.

In the production of coated abrasives the conventional technique employed is to coat a substrate with a curable maker coat and then to apply abrasive grits to the maker coat before it has become cured such that the grits are retained by the maker coat and are thereby anchored to the substrate. A size coat is conventionally applied over the grits to provide secure anchorage while the coated abrasive is actually in use. To enhance the performance of the abrasive grits, especially in the grinding of metals such as steels, it is often conventional to apply over the size coat a supersize coat comprising a binder and a grinding adjuvant. This adjuvant can be a lubricant or an antistatic additive to reduce loading of the coated abrasive during use. More commonly however the grinding adjuvant is a "grinding aid" which decomposes during use and the decomposition products of which facilitate removal of metal from the workpiece. The grinding adjuvant, to be most effective, should generally be located at the point of grinding, as close as possible to the point at which the abrasive grit contacts the metal workpiece.

The abrasive grits are conventionally applied to the maker coat using an electrostatic technique in which the grits are projected towards the maker coat. This application technique tends to align the grits such the longest dimension is perpendicular to the plane of the backing when the grit is anchored in place. This arrangement is very advantageous to the finished coated abrasive since it presents the smallest surface area of grit to the workpiece and maximizes the applied force per grit and therefore the effectiveness of the abrading process at a given power output.

In some respects however this can be a disadvantage since, if the grits have a weak shape, (defined as having a ratio of the longest dimension to the largest dimension perpendicular to the longest dimension, or "aspect ratio",) greater than about 1.5 the supersize layer tends to collect in the spaces between the grits and thus be removed from the grit tips, unless unusually large amounts of size coat and/or supersize coat are used.

In a conventional process for the manufacture of coated abrasives, a substrate or backing layer is prepared and then treated with a coat of a maker resin and a layer of abrasive grits is deposited thereon. The maker coat is then at least partially cured and a further binder coat, referred to as a size coat, is applied over the abrasive grits. With radiation cured binders, the cure of the maker coat is typically completed before application of the size coat.

The abrasive grits are applied either by gravity coating or by an electrostatic process in which the grits are impelled towards the surface to be coated by electrostatic forces. This electrostatic coating technique is referred to as the UP coating technique.

It has been discovered that, with premium aggressively cutting grits particularly, a closed coat, (that is a coat with the maximum amount of grit that can be deposited on a surface in a single layer), can lead to burning of the surface of the workpiece. Maximum efficiency is obtained when the load per active abrading grit is maximized during grinding and the cutting grits are spaced to give the workpiece an opportunity to cool between abrading events. One solution to this problem is proposed by U.S. Pat. No. 5,011,512 which teaches the incorporation of non-abrasive particles with a Knoop hardness less than about 200 along with the abrasive grits. The abrasive grits and non-abrasive particles were of the same size and the non-abrasive particles appear to space the abrasive grits allowing them to cut more efficiently. The "spacing" concept is often described in terms of "percent closed coat". This is calculated by measuring the amount of abrasive grits required to provide a monolayer coverage of a unit amount of the substrate and expressing the actual amount of abrasive particles applied per unit area as a percentage of the amount required to deposit a monolayer. Very similar teaching regarding spacing of abrasive grits using friable fillers is found in U.S. Pat. No. 1,830,757; U.S. Pat. No. 3,476,537; and EP 0 494,435-A1.

Efficiency of cutting is conventionally enhanced by the use of a supersize additive in the last applied layer of a coated abrasive. However a problem is encountered with abrasive grits of a weak shape. All grits with an aspect ratio greater than about 1.5 are described generically as having a "weak" shape. If these stand perpendicular to the surface to which they are bonded, (as is generally preferred), the cutting surface is far removed from the bulk of the supersize-containing layer. This problem can be solved by addition of very large amounts of size and supersize such that the spaces between the grits is filled up by the supersize formulation. However as the shapes get "weaker", this approach becomes much more expensive.

Weak shaped abrasive grits are obtainable by crushing larger particles using a rolls crusher. These however, while predominantly "weaker" in shape than impact crushed abrasive grain, do not in general have more than about 20% of the particles with an aspect ratio of more than 2:1.

In recent years a new form of grit has been developed that has a filamentary particle form with a substantially uniform cross-sectional shape and a length dimension perpendicular to that cross-section that is at least equal to, and more usually much larger than, the greatest dimension of the cross-section. Such grits will have the appearance of rods or cones or square-based pyramids for example.

One form of such grits is made from a sol-gel alumina that has been shaped into a filamentary particle shape before it is dried and fired to produce a remarkably effective abrasive grit. Such grits are described in U.S. Pat. No. 5,009,676 and coated abrasives made using them are described in U.S. Pat. No. 5,103,598. Another form of grits that is particularly well suited for use in the present invention are grits with a very weak shape but not necessarily having a uniform cross-sectional shape. "Weak" but non-uniform shapes are conventionally produced using a roll-crushing comminution technique. These have an aspect ratio somewhat greater than 1 but have very few grits with aspect ratios greater than 2:1, (usually less than 20%). However it has been found that explosive comminution of materials containing volatilizable material that form ceramics when fired yields much weaker shapes than are achievable using the conventional roll-grinding techniques. The production of such grits is described in U.S. Pat. No. 5,725,162. To the extent that they share the problems described above, these weak-shaped abrasive grits can also be used in the present invention.

With very weak-shaped grits, a very significant moment is developed, (which increases with the "weakness"), upon contact with a workpiece under abrading conditions. This can lead to premature fracture of the grit or even displacement from the backing of the whole grit. This could be cured by addition of a thicker size coat which would also solve the issue of the location of the supersize additive in the coating. However, as indicated above, this becomes very expensive and can also result in delays in curing and perhaps differences in extent of cure throughout the thickness of the size layer.

The present invention provides a novel way of overcoming the problem of grinding aid efficiency by permitting the placing of the grinding aid formulations at the point of maximum utility without the use of excessive amounts of the size or supersize formulations.

The problem also provides a way of ensuring that very weak shaped grits wear at a more uniform rate by ensuring that they are more securely anchored without the use of greater volumes of size coat than would be economic.

GENERAL DESCRIPTION OF THE INVENTION

The present invention provides a coated abrasive having a substrate and an abrasive layer adhered thereto, said abrasive layer comprising:

a) a maker coat;

b) abrasive grits at least 25% of which have an aspect ratio greater than 2:1, and from 5 to 50% by weight, based on the abrasive grit weight, of non-abrasive particles having an average largest dimension that is less than 75% of the average largest dimension of the abrasive grits, the abrasive grits and at least some of the non-abrasive particles being adhered to the maker layer; and c) a layer comprising a grinding adjuvant and a binder.

For the purposes of this specification, the term "average largest dimension" or the equivalent shall be understood to refer to the average largest dimension of a particle of weight average particle size.

Also for the purposes of this specification, "non-abrasive" particles shall be understood to refer to particles that are either hollow mineral particles such as for example glass, mullite or alumina bubbles, solid glass beads or, if non-mineral, solid or hollow particles of a resin or plastic material. Such particles have essentially no abrasive value in themselves but contribute to the more efficient operation of the abrasive grits with which they are mixed.

The coated abrasive of the invention preferably has a size layer overlaying the abrasive grits and non-abrasive particles. The layer comprising the grinding adjuvant and the binder then overlies the size layer. Alternatively or additionally the size layer itself can comprise a grinding adjuvant.

When a size coat is present, the non-abrasive particles raise the surface level of a size coat applied over the abrasive layer such that the abrasive grits are adhered over a greater proportion of their length without the necessity to increase the amount of the size used. This will also have the consequence that a supersize coat applied over the size coat and containing a grinding adjuvant, such as a grinding aid or an antistatic control additive to reduce "loading", (or a size coat comprising an adjuvant), will place the adjuvant closer to the tips of the abrasive grits where it is most effective.

The non-abrasive particles can also be added as particles pre-adhered to the abrasive grits by a relatively weak bond such that the abrasive grits are sheathed in non-abrasive particles provided that these do not interfere with the ability of the weak-shaped abrasive grits to withstand the normal grinding forces encountered during use. These tend to pluck out the abrasive grit before it has ceased to cut unless the grit is strongly held.

In another embodiment, there can be a plurality of abrasive layers making up the coated abrasive. Thus a layer of maker coat with adhered abrasive grits may be interpolated between the backing and the layer according to the invention. The nature of the abrasive grits in the interpolated layer is not critical. They can have the weak shapes of the grits in the primary layer according to the invention or they can be of a stronger shape and/or have inferior grinding properties. It is also not essential, though often preferred, to have the admixure of non-abrasive particles.

The products of the invention are particularly useful when the abrasive grits have aspect ratios such that at least 40%, and even more preferably at least 75%, exceed 2:1. It is also most advantageous when the abrasive grits are applied in an amount sufficient to give a 75% closed coat, or more preferably a 60% or lower closed coat, such as from about 40 to 50% closed coat.

The invention also comprises a process for the production of a coated abrasive which comprises application of a maker coat to a substrate and the application to said maker coat, by an electrostatic deposition process, of an abrasive layer comprising abrasive grits, at least 25% of which have an aspect ratio of at least 2:1, and from 5 to 40%, based on the abrasive grits, weight of non-abrasive particles having an average particle size that is less than 75% of the average longest dimension of the abrasive grits, and thereafter at least partially curing the maker coat. The non-abrasive particles can be applied at the same time as the abrasive grits in the same UP coating process. Alternatively the non-abrasive particles can be deposited in a separate UP or gravity fed deposition process.

SPECIFIC DESCRIPTION OF THE INVENTION

The non-abrasive particles have a largest dimension that is no greater than 75%, and preferably from 10 to 50%, of the largest dimension of the abrasive grits such that the non-abrasive particles are small enough to occupy the spaces between the abrasive grits.

In general it is preferred that the non-abrasive particles have a less weak shape than the abrasive grits and are more preferably substantially spherical. The purpose of this is to maximize the volume for the smallest actual weight. The average maximum dimension of the non-abrasive particles is most preferably not greater than twice the average value of the greatest cross-sectional diameter perpendicular to the longest dimension of the abrasive grits, and more preferably from about 30 to 100% of this dimension.

Suitable materials for the non-abrasive particles include particles of a polyolefin such as polyethylene or polypropylene, a nylon such as nylon 66, a polyester such as PET and polystyrene. The particles can comprise dissolved pneumatogen such that the particles can be added in relatively small amounts of very small size and can be expanded, perhaps in the process of curing the maker coat or in a separate operation, to more effectively fill the spaces between the abrasive grits.

Other suitable materials include hollow or solid glass bubbles, mullite bubbles or spheres and ceramic bubbles such as bubble alumina.

The non-abrasive particles are applied before the application of the size coat. It is however possible to apply the grit along with the non-abrasive particles using a UP procedure providing a voltage selected is capable of depositing both the grit and the particles. Because the non-abrasive particles are usually so much smaller and lighter than the abrasive grits, they are more easily moved and can therefore preferentially coat the maker leaving no space for the abrasive grits to occupy. Problems with the relative readiness with which the particles are deposited can be resolved by coating the abrasive grits with a weak bond material and then adhering the non-abrasive particles to the abrasive grits before they are deposited on the substrate. It is also possible to apply the non-abrasive particles after deposition of the abrasive grits.

The amount of the non-abrasive particles added can be from about 5% to about 40%, for example from 5 to 30% and more preferably from 8 to 20% by weight, based on the weight of the abrasive grits. Of course this must necessarily be a rough guide as the relative weights of the abrasive grits and non-abrasive particles can vary within a wide range.

The abrasive grits comprise at least 25% and preferably 40%, and more preferably at least 80% of grits with an aspect ratio of at least 2:1. These are most suitably the result of a shaping process that results in a uniform cross-sectional shape such as round, star-shaped, rectangular or polygonal. Suitable processes include extrusion of a sol-gel alumina followed by cutting, drying and firing; molding; screen printing and the like.

It is also possible to use the weak shaped abrasive grits produced by the explosive comminution process described in PCT Patent Application Number PCT/US 96/04137.

The preferred abrasive grits comprise alumina and most preferably a sol-gel alumina. However other materials such as silicon carbide, fused alumina/zirconia, cubic boron nitride and diamond can be used. It is possible to use blends of premium abrasive grits with cheaper less effective abrasive grits. It is also possible to provide that the coated abrasive receives a double coating of the abrasive layer provided that the outermost layer is one according to the invention.

The grinding adjuvant is typically a grinding aid but it can also be another additive designed to increase the metal removal rate, reduce the accumulation of surface swarf, reduce static build-up on the surface of the coated abrasive and/or to allow the abrasive to cut more freely with less temperature build-up. Such additives include grinding aids, anti-static additives, anti-blocking additives, lubricants and the like. Examples of such adjuvants include potassium fluoroborate, cryolite, iron sulfide, liquid or solid halogenated hydrocarbons, graphite, carbon black and metal stearates.

The nature of the substrate material is not critical and woven, knit or stitchbonded fabrics are quite suitable for the practice of the invention. In addition polymer films, fiber mats and the usual range of treated papers may also be used. The substrates may be prepared in the conventional way by application of one or more of filler, back-size and front size formulations.

DESCRIPTION OF THE DRAWINGS

In FIG. 1 the particles are comparable to the cross-sectional diameter of the abrasive grits. FIG. 2 shows a double coated structure in which each coating is comparable to that shown in FIG. 1. In FIG. 3 the non-abrasive particles are added attached to the abrasive grits.

DESCRIPTION OF PREFERRED EMBODIMENTS OF THE INVENTION

The invention is described with reference to the Drawings appearing as FIGS. 1 to 3 of the attached drawings which are solely for the purpose of illustration and are intended to imply no necessary limitation on the scope of the invention.

Figure 1:
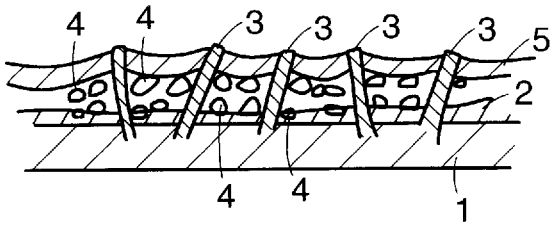
FIGS. 1 to 3 are diagrammatic cross-sectional views of a coated abrasive according to the invention in which the non-abrasive particles are combined with weak shaped abrasive grits.
Figure 2:
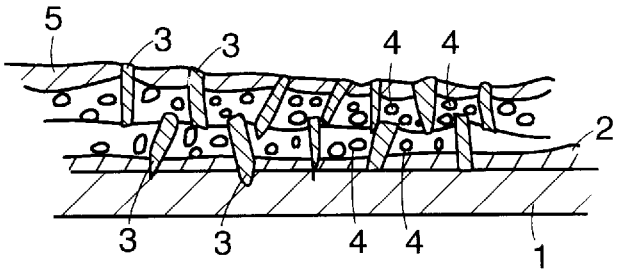
Figure 3:
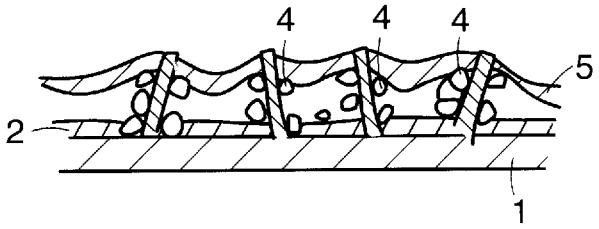

Referring to FIGS. 1 to 3 of the Drawings, a substrate 1, is provided with a make coat to which are applied filamentary abrasive grits, 3 and non-abrasive particles, 4. In FIGS. 1 and 2 the non-abrasive particles occupy the space between adjacent abrasive grits. In FIG. 3 the non-abrasive particles are actually attached to the abrasive grits by, for example, an adhesive or other temporary binder. A size coat, 6, is applied over the abrasive grits and the non-abrasive particles. Some of the non-abrasive particles may become dispersed in this size coat as shown in the drawings. In FIG. 2 a second layer of abrasive grits and non-abrasive particles is applied over the size coat followed by another size coat. The last coat applied is a supersize coat which overlies the size coat. As will be appreciated, the volume occupied by the non-abrasive particles corresponds to the amount of size coat that is not needed to ensure that the supersize coat is located at or near the tips of the abrasive grits. In addition it will be appreciated that, because the abrasive grits are anchored along a greater proportion of the body of the grits than would be the case if the same amount of size were used without the non-abrasive particles, the moment exerted when a weak shaped abrasive grit contacts a work piece is much reduced because the distance from the point of force application to the grit anchoring point is so much shorter. As a result the chance that significant loss by fracture is much reduced.

What is claimed is:

1. A coated abrasive having a substrate and an abrasive layer adhered thereto, said abrasive layer comprising:

a) a maker coat;

b) abrasive grits at least 25% of which have an aspect ratio greater than 2:1, and from 5 to 50% by weight, based on the abrasive grit weight, of non-abrasive particles having an average largest dimension that is less than 75% of the average largest dimension of the abrasive grits, the abrasive grits and at least some of the non-abrasive particles being adhered to the substrate by the maker coat; and c) a layer comprising a grinding adjuvant and a binder.

2. A coated abrasive according to claim 1 in which the abrasive grits are present in amounts required to give a 75% or lower closed coat.

3. A coated abrasive according to claim 1 in which at least 40% of the abrasive grits have an aspect ratio greater than 2:1.

4. A coated abrasive according to claim 1 in which the non-abrasive particles are substantially spherical in shape.

5. A coated abrasive according to claim 1 in which the non-abrasive particles are selected from the group consisting of glass and alumina bubbles, and glass, mullite and polymer beads.

6. A coated abrasive according to claim 1 in which the abrasive grits are formed from a sol-gel alumina.

7. A coated abrasive according to claim 6 in which the sol-gel alumina is a seeded sol-gel alumina.

8. A coated abrasive according to claim 1 in which the abrasive grits are filamentary abrasive grits having an essentially uniform cross-section along a length dimension.

9. A process for the production of a coated abrasive which comprises:

a) applying a maker coat to a substrate;

b) electrostatically depositing abrasive grits at least 25% of which have an aspect ratio of at least 2:1 on the maker coat before curing thereof, and simultaneously or subsequently, depositing from 5 to 50% by weight, based on the abrasive grits' weight, of non-abrasive particles having a longest dimension that is less than 50% of the average longest dimension of the abrasive particles, and thereafter at least partially curing the maker coat; and c) depositing a size layer over the layer of abrasive grits and non-abrasive particles.

10. A process according to claim 9 in which a supersize coat comprising a grinding adjuvant and a binder is deposited over the size coat.

* * * * *